US006393663B1

(12) United States Patent
Lin

(10) Patent No.: US 6,393,663 B1
(45) Date of Patent: May 28, 2002

(54) FURNITURE HINGE

(76) Inventor: John C. L. Lin, No. 146, Min-Chuan Road, Da-Hu Village, Hu-Ne Hsian, Kaohsiung Hsien (TW)

( * ) Notice: Subject to any disclaimer, the term of this patent is extended or adjusted under 35 U.S.C. 154(b) by 82 days.

(21) Appl. No.: 09/657,587

(22) Filed: Sep. 8, 2000

(51) Int. Cl.[7] ..... E05F 1/08
(52) U.S. Cl. ..... 16/335; 16/336; 16/299
(58) Field of Search ..... 16/335, 336, 295, 16/296, 297, 299, 308

(56) References Cited

U.S. PATENT DOCUMENTS 5,617,612 A 4/1997 Ferrari et al. ..... 16/278

*Primary Examiner*—Anthony Knight
*Assistant Examiner*—Mark Williams

(74) *Attorney, Agent, or Firm*—Bacon & Thomas, PLLC

(57) ABSTRACT

A hinge in accordance with the present invention comprises a first element and a second element pivoted together to reciprocally rotate from an open position to a closed position. The first element includes a hollow central body, a hinge pin and a fastening pin being transversely mounted in the hollow central body. The second element includes a strip extended therefrom. The strip includes an opening in a middle thereof. A distal portion of the strip is extended into the hollow central body and wound around the hinge pin so as to form a stop that is associated with the opening. A spring is mounted around the fastening pin. The spring includes a first end attached to a bottom of the hollow central body and a second end that is extended through the opening and attached to the stop of the strip, thereby providing control between the first element and the second element by elasticity of the spring.

2 Claims, 1 Drawing Sheet

FURNITURE HINGE

BACKGROUND OF THE INVENTION

1. Field of the Invention

The present invention relates to an element with an improved strip structure for improving load capacity of a furniture hinge.

2. Description of the Related Art

U.S. Pat. No. 5,617,612 to Ferrari et al. on Apr. 8, 1997 discloses a furniture hinge comprising a first cup-shaped element and a second arm-shaped element pivoted together to rotate reciprocally from an open position to a closed position. The arm-shaped element is made of sheet metal with one end bent to wined wound a hinge pin supported in the cup-shaped member. The bent end of the arm-shaped element also defines bearing surfaces for a double twist pressure spring which pushes the arm-shaped element and the cup-shaped element toward the closed position starting from a position close to the latter. A U-bolt forms the hinge pin and a pin supporting the spring.

Since the arm of the arm-shaped element bears the overall weight of the door and the arm must be configured to have a neck for cooperating two resting surfaces for the spring, the arm is punched to provide improved structural strength; yet it was found that the punching fails to provide required improved strength. In addition, it is complicated to form the resting surfaces on the arm. Furthermore, it is inconvenient to position and bend the resting surfaces during assembly.

SUMMARY OF THE INVENTION

It is the primary object of the present invention to provide an improved arm-shaped element for a furniture hinge, wherein the arm-shaped element includes a strip extended therefrom. Structural strength of the strip is improved by increasing the width thereof, and the strip includes an opening to simplify the structural. The strip is bent and thus mounted to a hollow central body of the hinge. The opening in the strip is associated with an end of each of two springs of the hinge, thereby allowing easy assembly of the hinge.

A hinge in accordance with the present invention comprises a first element and a second element pivoted together to reciprocally rotate from an open position to a closed position. The first element includes a hollow central body, a hinge pin and a fastening pin being transversely mounted in the hollow central body. The second element includes a strip extended therefrom. The strip includes an opening in a middle thereof. A distal portion of the strip is extended into the hollow central body and wound around the hinge pin so as to form a stop that is associated with the opening. A spring is mounted around the fastening pin. The spring includes a first end attached to a bottom of the hollow central body and a second end that is extended through the opening and attached to the stop of the strip, thereby providing control between the first element and the second element by elasticity of the spring.

When the second element is in the closed position, the second end of the spring is attached to the stop of the strip and thus cannot be rotated until the spring force of the spring is overcome by moving the second end of the spring across the stop. When the second element rotates, rotation of the second element is impeded by the spring.

Other objects, specific advantages, and novel features of the invention will become more apparent from the following detailed description and preferable embodiments when taken in conjunction with the accompanying drawings.

DETAILED DESCRIPTION OF THE PREFERRED EMBODIMENT

A preferred embodiment in accordance with the present invention will now be described with reference to the accompanying drawings.

Figure 2:
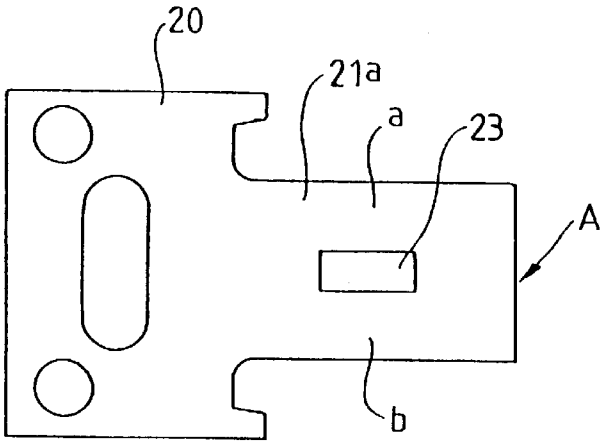
FIG. 2 is a view of an element made of sheet metal, after blanking and before forming.
Figure 1:
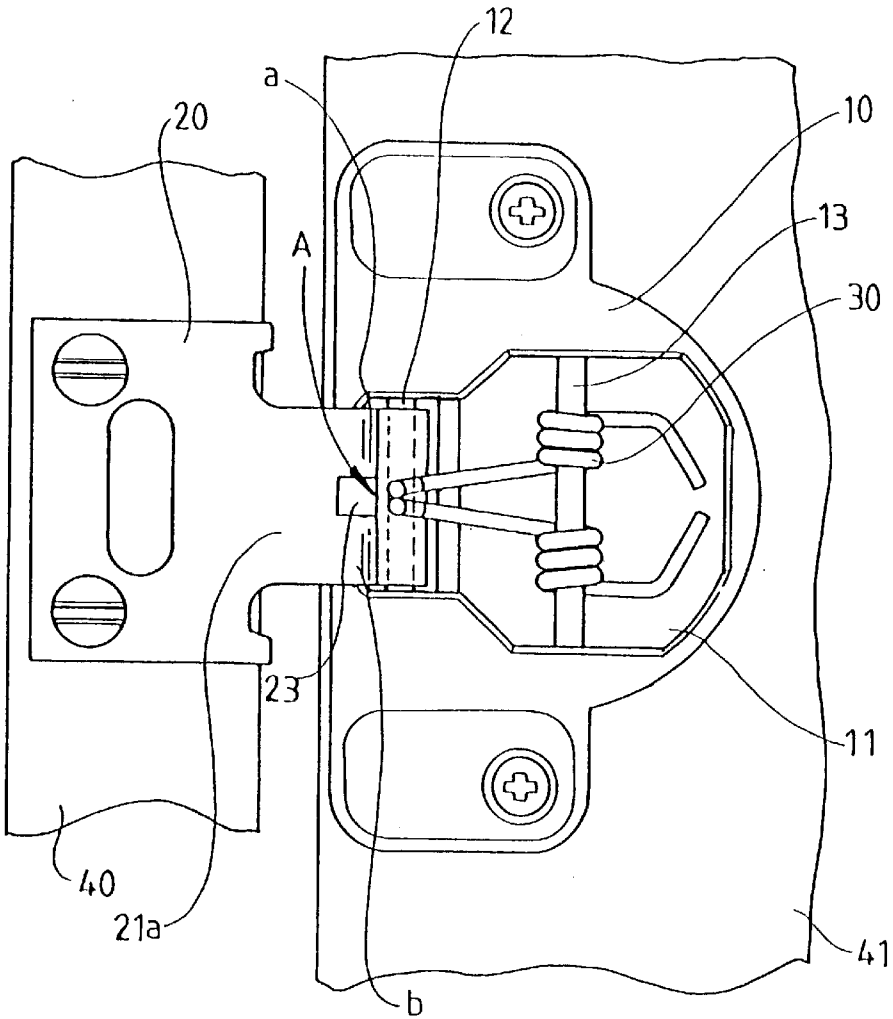
FIG. 1 is front view of a hinge in accordance with the present invention in an open position.

Referring to FIGS. 1 and 2, a hinge in accordance with the present invention generally includes a first cup-shaped element 10 and a second arm-shaped element 20 pivoted together to reciprocally rotate from an open position to a closed position. The first element 10 includes a hollow central body 13 having therein a central recess designed to be fitted into a complementary housing made in a door 41. A hinge pin 12 and a fastening pin 13 are transversely mounted to the central body 13 in a parallel manner. The second element 20 is mounted to a side panel 40 of a furniture unit. Such a structure has been disclosed in U.S. Pat. No. 5,617,612.

The present invention is characterized by that the second element 20 includes a strip 21*a* which has a longitudinally extending opening 23 in a middle thereof, thereby defining two lateral arms a and b, best shown in FIG. 2. The strip 21*a* includes a distal portion designed to be extended into the hollow central body 11 and wound around the hinge pin 21. In addition, the distal portion of the strip 21*a* will be bent around the hinge pin 21 to directly form a stop A to which an end of each of two springs 30 is attached. In particular, each spring 30 includes a coil portion (not labeled) wound around the fastening pin 13 with a first end of each spring 30 attached to a bottom of the central body 11 and with a second end of each spring 30 attached to then stop A of the strip 21*a* after passing through the opening 23. In response to rotation of the second element 20, about the hinge pin 12, the stop A rotates synchronously on the hinge pin 12 to control opening and closing of the hinge. In addition, when the second element 20 rotates, the springs 30 impede rotational movement of the second element 20.

When the door 41 is in the closed position, the second end of each spring 30 is attached to the stop A of the strip 21*a* and thus cannot be rotated. Thus, the spring force must be overcome for opening the door 41 by moving the second end of each spring 30 across the stop A and into the opening. Once the door 41 is opened, the second end of each spring 30 is still attached to the distal portion of the strip 21*a*, thereby impeding rotation of the door 41 relative to the side panel 40 of the furniture unit.

It is noted that the sum of the width of the arm a and the width of the arm b is greater than that of the strip of the second element disclosed in U.S. Pat. No. 5,617,612. Thus, a strip 21*a* with improved structural strength is provided. This allows the hinge to bear a heavier door. In addition, formation and assembly of the hinge in accordance with the present invention are much simpler than those for the hinge disclosed in U.S. Pat. No. 5,617,612, for the resting surfaces of the second arm-shaped element of the hinge disclosed in U.S. Pat. No. 5,617,612 are not required in the hinge of the present invention.

Although the invention has been explained in relation to its preferred embodiment as mentioned above, it is to be understood that many other possible modifications and variations can be made without departing from the scope of the invention. It is, therefore, contemplated that the appended claims will cover such modifications and variations that fall within the true scope of the invention.

What is claimed is:

1. A hinge comprising:

a first element including a hollow central body, a hinge pin and a fastening pin being transversely mounted in the hollow central body;

a second element including a strip extended therefrom, the strip including an opening in a middle thereof, the strip including a distal portion that is extended into the hollow central body and wound around the hinge pin and forms a stop that is associated with the opening; and a spring mounted around the fastening pin, the spring including a first end attached to a bottom of the hollow central body and a second end that is extended through the opening and attached to the stop of the strip, thereby providing control between the first element and the second element by elasticity of the spring;

whereby when the second element is in the closed position, the second end of the spring is attached to the stop of the strip and thus cannot be rotated until the spring force of the spring is overcome by moving the second end of the spring across the stop and into the opening; and when the second element rotates, rotation of the second element is impeded by the spring.

2. The hinge as claimed in claim 1, wherein the opening extends along a longitudinal direction of the strip.

* * * * *